United States Patent [19]

Prinz et al.

[11] 4,401,488

[45] Aug. 30, 1983

[54] GOLD-COLORED COIN MATERIAL

[75] Inventors: Bruno Prinz, Oberursel; Manfred B. Rockel, Friedrichsdorf; Günther Rudolph, Neuberg; Ulrich Heubner, Werdohl; Hugo Zoebe, Altena, all of Fed. Rep. of Germany

[73] Assignee: Vereinigte Deutsch Metallwerke AG, Frankfurt am Main, Fed. Rep. of Germany

[21] Appl. No.: 370,691

[22] Filed: Apr. 22, 1982

[30] Foreign Application Priority Data

Apr. 23, 1981 [DE] Fed. Rep. of Germany ..... 3116135

[51] Int. Cl.[3] ..... C22C 9/01; C22C 9/06

[52] U.S. Cl. ..... 148/435; 420/486; 428/675

[58] Field of Search ..... 75/159, 162; 428/675; 420/486; 148/435, 436

[56] References Cited

U.S. PATENT DOCUMENTS

| | | | |
|---|---|---|---|
| 1,916,602 | 7/1933 | Braddock | 75/162 |
| 2,031,315 | 2/1936 | Jennison | 75/162 |
| 4,292,377 | 9/1981 | Petersen et al. | 428/675 |
| 4,330,599 | 5/1982 | Winter et al. | 428/675 |

*Primary Examiner*—Peter K. Skiff

*Attorney, Agent, or Firm*—Sprung, Horn, Kramer & Woods

[57] ABSTRACT

An alloy useful as a coinage alloy, especially as a cladding for a coin comprising a core and a cladding is disclosed. The alloy consists essentially of 4 to 6% nickel, 4 to 6% aluminum, balance copper and inevitable impurities which are due to the manufacture. Also disclosed are coins made therefrom having a gold-like color.

5 Claims, 1 Drawing Figure

GOLD-COLORED COIN MATERIAL

BACKGROUND OF THE INVENTION

1. Field of the Invention

This invention relates to the used of a copper-base alloy containing 4 to 6% nickel, 4 to 6% aluminum balance copper and inevitable impurities due to the manufacture, as a material for use in the making of coins or the like which are required to have a golden color and a high resistance to tarnishing.

2. Discussion of Prior Art

The inflationary tendencies which have prevailed throughout the world for years and differ in strength in various countries, and the considerable increase of transactions effected with the aid of machines for vending merchandize and services, have resulted in a need for coins having a high value. For instance, the introduction of a 10-mark coin has been considered in Germany for some time. In most of the existing systems of coins, it would not be practicable to provide larger coins for a distinction from the most valuable existing coins because the heavier weight and the larger volume would render the handling more difficult. Additionally, the larger coins would require a considerable quantity of metal. Moreover, rising prices of the metals which can be used in coins will have the result to decrease the difference between the metal value and the face value of the coins. For this reason the public authorities who are responsible for the coinage consider the issuing of new coins which have higher values and are smaller and differ in color from the most valuable existing coins. Gold colors are particularly desirable for such purpose because they are associated with a high value and most coins in circulation, at least those having high values, are silver-colored.

Coin materials having a goldlike color are known and some of them have already been used. They consist almost without exception of copper-base alloys, which contain, e.g., 25% zinc, or 20% zinc and 1% nickel, or 5 to 6% aluminum and 2% nickel, or 2% aluminum and 6% nickel. These materials have the disadvantage that they lose their original bright appearance rather quickly in use and assume a dull color having a brownish tinge. Whereas this disadvantage is tolerated with coins having low values, a rapid discoloration of highly valuable coins in use is not acceptable. For this reason, silver-colored materials, particularly nickel alloys, have previously been used for coins of high values.

It is desired to provide a gold-colored material which can be used to make coins or the like and call well be processed to make coins by casting, rolling and stamping and has a high resistance to tarnishing so that it retains as long as possible the original golden color.

SUMMARY OF INVENTION

It has surprisingly been found that this object can be accomplished if the material used to make coins or the like consists essentially of a copper-base alloy which contains 4 to 6% nickel, 4 to 6% aluminum, balance copper and inevitable impurities which are due to the manufacture. The copper alloy preferably contains also 0.5 to 1.8% iron and/or 0.3 to 1.5% manganese. The copper alloy may also contain 0.05 to 0.30% silicon because this will further improve the resistance to tarnishing. The above percentages are percentages by weight.

That copper-base alloy may also be used as a cladding material in the making of coins or the like which have a core layer of another metal, preferably nickel.

Figure 1:
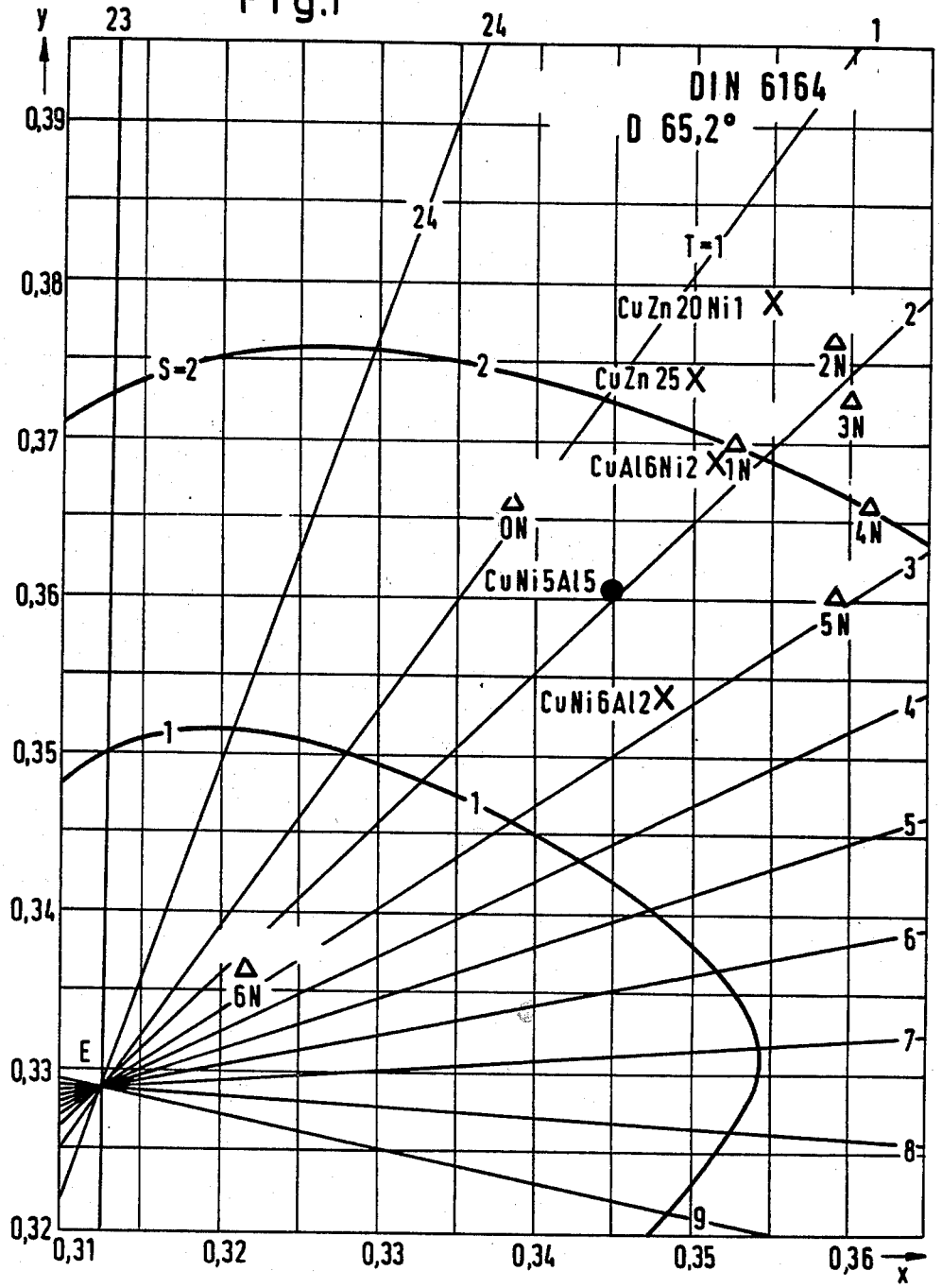
FIG. 1. The accompanying figure is a graph in accordance with Deutsche Industrie Norm (DIN) 6164 of a color system from which color saturation can be determined.

To test the resistance to tarnishing, stamped coin blanks made from the copper-base alloy to be used according to the invention, containing 5%, Ni, 5% Al, 1.2% Fe and 0.8% Mn in a stamped or unstamped form, were first subjected to the following pretreatment:

Bright pickling
Rinsing in water
Treating with a polishing agent
Drying in rice grits without previous rinsing
Optional stamping without additional lubricant That pretreatment was required for a test of the stamped or unstamped coin blanks for resistance to tarnishing in that state in which they are used in practice. The coin blanks were also degreased in order to remove any fingerprints before the tarnishing test.

The tests were carried out under the following atmospheric conditions differing in agressiveness:

(A) Exposure to room temperature in the corrosion-testing laboratory. The coins were touched with the fingers and turned around every day.

(B) Exposure to room temperature in the corrosion-testing laboratory.

(C) Exposure to room temperature over a 10% solution of NaCl. .

(D) Exposure to room temperature over 80% relative humidity.

(E) Exposure to 45° to 50° C. in the corrosion-testing laboratory.

(F) Exposure to room temperature and 100% relative humidity.

After a testing time of 20 days, the specimens were taken and the coins tested under given conditions were visually inspected and rated from 1 to 5 in accordance with a predetermined system. Rating 1 indicates a very high resistance to tarnishing and rating 5 indicates a very low resistance to tarnishing and a highly tarnished surface.

Blank coins from the above-mentioned known copper-base alloys (samples 1 to 4) were similarly pretreated and tested. The results are complied in Table 1.

TABLE 1

| Sample No. | A | B | C | D | E | F | Total |
|---|---|---|---|---|---|---|---|
| Comparison Example 1, CuZn25 | 3 | 4 | 3 | 3 | 4 | 5 | 22 |
| Comparison Example 2, CuZn20Ni1 | 4 | 4 | 4 | 3 | 4 | 5 | 24 |
| Comparison Example 3, CuAl6Ni2 | 2 | 4 | 3 | 3 | 4 | 3 | 19 |
| Comparison Example 4, CuNi6Al2 | 3 | 4 | 3 | 2 | 5 | 5 | 22 |
| Example 5, CuNi5Al5Fe1.2 Mn0.8 | 1 | 3 | 3 | 3 | 2 | 3 | 15 |

The rating of samples 1 to 4 totalled between 19 and 24. The corresponding total rating of 15 for sample 5 made of the copper-base alloy to be used according to the invention is much lower. This shows that said alloy is clearly superior to all copper-base alloys previously used as a coin material as far as resistance to tarnishing is concerned.

The golden colors were ascertained by a determination of the chromaticity coordinates in accordance with DIN 5033 and the coordinates of the color chart in accordance with DIN 6164 by a measurement of the spectral reflection. The hue T, the saturation S and the darkness value D in the form of the chromaticity coordinates T:S:D of the color chart in accordance with DIN 6164 are compiled in Table 2 for the copper alloys which have been tested:

TABLE 2

| Sample No. | Chromaticity Coordinates (T:S:D) in accordance with DIN 6164 |
|---|---|
| Comparison Example 1, CuZn25 | 1.4:2.1:0.3 |
| Comparison Example 2, CuZn20Ni1 | 1.4:2.3:0.3 |
| Comparison Example 3, CuAl6Ni2 | 1.8:2.0:0.6 |
| Comparison Example 4, CuNi6Al2 | 2.8:1.4:0.7 |
| Example 5, CuNi5Al5Fe1.2Mn0.8 | 2.0:1.6:0.6 |

FIG. 1 shows a portion of the color triangle in accordance with DIN 6164. The gold colors according to DIN (Δ), the goldlike colors of the above-mentioned copper-base coin alloys (samples 1 to 4=x) and the gold color of the alloy according to the invention (•) have been entered.

It is apparent that the alloy CuNi5Al5Fe1.2Mn0.8 is superior in color saturation to the allow CuNi6Al2 because it has a smaller difference from the saturations of the DIN gold colors and that its hue lies between red and gold and the gold color greenish yellow.

The copper alloy according to the invention which contains 4 to 6% nickel and 4 to 6% aluminum is highly suitable owing to its composition for the making of a laminated coin blank having core of nickel. Such material may be used to make coin blanks which will prevent a misuse of a vending machine. Even if the nickel core has a thickness of only 7%, the scrap which becomes available in the punching of circular blanks can easily be recycled.

What is claimed is:

1. A coin made of an alloy consisting essentially of 4 to 6 percent nickel, 4 to 6 percent aluminum, 0.5 to 1.8 percent iron, the balance being copper and inevitable impurities due to manufacture.

2. A coin according to claim 1 containing 0.5 to 1.2 percent iron.

3. A coin according to claim 1 additionally containing 0.3 to 1.5 percent manganese.

4. A coin according to claim 2 additionally containing 0.3 to 1.5 percent manganese.

5. A coin according to claim 1 wherein said coin comprises a core and a cladding disposed on said core, said cladding comprises a copper base alloy consisting essentially of 4 to 6 percent nickel, 4 to 6 percent aluminum, 0.5 to 1.8 percent iron, the balance copper and inevitable impurities due to manufacture.

* * * * *